US010066435B2

(12) United States Patent
Tomlinson

(10) Patent No.: US 10,066,435 B2
(45) Date of Patent: Sep. 4, 2018

(54) MODULAR DOOR RAIL

(71) Applicant: Rockwood Manufacturing Company, Rockwood, PA (US)

(72) Inventor: William Tomlinson, Mooreville, MS (US)

(73) Assignee: ASSA ABLOY Accessories and Door Conrtols Group, Inc., New Haven, CT (US)

( * ) Notice: Subject to any disclaimer, the term of this patent is extended or adjusted under 35 U.S.C. 154(b) by 0 days.

(21) Appl. No.: 15/643,020

(22) Filed: Jul. 6, 2017

(65) Prior Publication Data

US 2018/0010383 A1 Jan. 11, 2018

Related U.S. Application Data

(60) Provisional application No. 62/359,832, filed on Jul. 8, 2016.

(51) Int. Cl.

| | |
|---|---|
| ***E06B 3/54*** | (2006.01) |
| ***E06B 7/28*** | (2006.01) |
| ***E06B 1/52*** | (2006.01) |
| ***E06B 3/26*** | (2006.01) |
| ***E06B 3/88*** | (2006.01) |
| *E06B 3/70* | (2006.01) |

(52) U.S. Cl.
CPC ..... *E06B 7/28* (2013.01); *E06B 1/52* (2013.01); *E06B 3/26* (2013.01); *E06B 3/5454* (2013.01); *E06B 3/88* (2013.01); *E06B 2003/7096* (2013.01)

(58) Field of Classification Search
CPC ..... E06B 1/52; E06B 3/26; E06B 3/88; E06B 3/5454; E06B 7/28; E06B 2003/7096
USPC ..... 52/204.7
See application file for complete search history.

(56) References Cited

U.S. PATENT DOCUMENTS 2,024,192 A * 12/1935 Verhagen ..... B61D 25/00 49/489.1
3,177,533 A * 4/1965 Davis ..... B62D 33/044 52/204.591
4,255,902 A * 3/1981 Ruff ..... E06B 7/2316 49/482.1

(Continued)

*Primary Examiner* — Charles A Fox
*Assistant Examiner* — James Buckle, Jr.
(74) *Attorney, Agent, or Firm* — DeLio, Peterson, and Curcio, LLC; David R. Pegnataro

(57) ABSTRACT

A modular rail assembly for securing a panel in a door or window, comprising a rail framing member having vertically-oriented sides interconnected by a partition plate to form first and second receiving channels on opposite sides of the partition plate, the second receiving channel defined at a top side by the partition plate and on opposing sides by receiving channel walls, and a rail base extension slideably secured within the rail framing member second receiving channel. The rail base extension includes vertically-oriented sides interconnected by a partition plate, the rail base extension sides having mating surfaces on opposing external surfaces thereof for mating with internal surfaces of the rail framing member second receiving channel walls. A fastener secures the rail base extension to the rail framing member, and a panel is secured along a longitudinal axis thereof in the first receiving channel of the rail framing member.

19 Claims, 4 Drawing Sheets

(56) References Cited

U.S. PATENT DOCUMENTS

| | | | | | |
|---|---|---|---|---|---|
| 4,712,331 | A * | 12/1987 | Fujiwara | E06B 7/2316 | 49/482.1 |
| 4,850,144 | A * | 7/1989 | Grisham | E06B 3/08 | 49/482.1 |
| 5,657,591 | A * | 8/1997 | Kitada | E06B 3/5454 | 49/501 |
| 6,609,350 | B1 * | 8/2003 | Weber | B32B 17/10036 | 52/784.1 |
| 6,851,244 | B2 * | 2/2005 | Vilhauer | E06B 3/9642 | 52/656.2 |
| 7,644,542 | B2 * | 1/2010 | Ambrozus | E05D 15/0669 | 49/411 |
| 7,644,552 | B2 * | 1/2010 | Kuipers | E04B 2/7424 | 52/204.71 |
| D616,567 | S * | 5/2010 | Desrosiers | D25/122 | |
| D616,568 | S * | 5/2010 | Desrosiers | D25/122 | |
| 8,387,332 | B2 * | 3/2013 | Piano | E04B 2/7455 | 52/204.1 |
| 8,997,412 | B1 * | 4/2015 | Header | E06B 1/524 | 52/204.71 |
| 2002/0121071 | A1 * | 9/2002 | Heung-Bin | E06B 7/23 | 52/800.11 |
| 2004/0128931 | A1 * | 7/2004 | Sprague | E06B 3/5454 | 52/480 |

* cited by examiner

MODULAR DOOR RAIL

BACKGROUND OF THE INVENTION

1. Field of the Invention

The present invention relates to door rail systems conventionally used to hold door panels, such as plate glass panes or panels, either in a doorway opening or for use as a wall partition. Typically, the rail system runs along one or more edges of the panel and secures the panel at its edges. In some conventional designs, the rail system is permanently attached to the glass pane; however in other designs, the pane may be detachably removed by way of a clamping mechanism inside the rail housing.

2. Description of Related Art

In prior art door rail systems, a problem exists when trying to create an extended door rail height, such as a 10" door rail, from an existing conventional door rail, such as a 4" or 6" door rail. Currently, if a vendor wants to create a 10" door rail from a 6" door rail, for example, the vendor will use a false cladding on the top of the rail, causing the customer to have to buy an additional 4" piece of glass, and requiring significant additional tooling and cost. This technique often also results in issues with tolerances.

A need exists for a customizable modular rail assembly that allows for the creation of a larger door rail from an existing smaller rail, and which is adaptable to an existing pane of glass without requiring additional tooling and glass hardware.

SUMMARY OF THE INVENTION

Bearing in mind the problems and deficiencies of the prior art, it is therefore an object of the present invention to provide a customizable modular rail assembly including a rail build-up or extension piece that allows for the creation of a larger door rail from an existing smaller rail.

It is another object of the present invention to provide a modular door rail for a glass door which eliminates the need to purchase a new, larger piece of glass when a larger glass door is required.

A further object of the invention is to provide a modular door rail extension which is securable to an existing glass door rail and extends the door rail for panels shorter than the door frame to which the door is to be installed.

It is yet another object of the present invention to provide a modular door rail extension for field installation which is easily secured to an existing door rail.

Still other objects and advantages of the invention will in part be obvious and will in part be apparent from the specification.

The above and other objects, which will be apparent to those skilled in the art, are achieved in the present invention which is directed to a modular rail assembly for securing a panel in a door or window. The modular rail assembly comprises a rail framing member having vertically-oriented sides interconnected by a partition plate to form first and second receiving channels on opposite sides of the partition plate, the second receiving channel defined at a top side by the partition plate and on opposing sides by receiving channel walls, and a rail base extension slideably secured within the rail framing member second receiving channel. The rail base extension includes vertically-oriented sides interconnected by a partition plate, and the rail base extension sides have mating surfaces on opposing external surfaces thereof for mating with internal surfaces of the rail framing member second receiving channel walls when inserted therein. A fastener, such as a steel set screw, secures the rail base extension to the rail framing member, and a panel may be secured along an edge thereof in the first receiving channel of the rail framing member.

One of the rail base extension mating surfaces or the rail framing member receiving channel walls may comprise an elongated groove and the other of the rail base extension mating surfaces or the rail framing member receiving channel walls may include an elongated protrusion capable of being slidably received in the elongated groove when the rail base extension is slidably inserted within the rail framing member second receiving channel. The rail base extension mating surfaces and the rail framing member receiving channel walls may also each include at least one corresponding discontinuity for providing additional mating surfaces when the rail base extension is slidably inserted within the rail framing member second receiving channel.

When the modular rail assembly is fully-assembled, the external surfaces of the rail framing member and rail base extension form a substantially flush continuous surface when viewed in a direction normal to a plane formed by the panel.

The rail base extension may further comprise channel walls defining an accessory channel space defined at a top side by the rail base extension partition plate, the accessory channel space for holding various door-related accessories, such as tumbler locks, end-loading arms, side-loading arms, pivots, sweeps and dust barriers. The rail base extension channel walls may further include at least one of a protrusion and a discontinuity on an interior surface thereof for securing one or more door-related accessories within the accessory channel space.

The rail base extension may further comprise a horizontally-oriented linking plate at a top end thereof, the linking plate including in an elongated groove for receiving the fastener securing the rail base extension to the rail framing member. In an embodiment, the fastener may be a set screw which abuts a detent in the rail framing member partition plate to secure the rail base extension to the rail framing member.

In another aspect, the present invention is directed to a method of assembling a rail assembly for securing a panel in a door or window. The method comprises providing a rail framing member having vertically-oriented sides interconnected by a partition plate to form first and second receiving channels on opposite sides of the partition plate, the second receiving channel defined at a top side by the partition plate and on opposing sides by receiving channel walls; providing a rail base extension adapted to be received within the rail framing member second receiving channel, the rail base extension including vertically-oriented sides interconnected by a partition plate, the rail base extension sides having mating surfaces on opposing external surfaces thereof for mating with internal surfaces of the rail framing member second receiving channel walls; and providing a fastener for securing the rail base extension to the rail framing member. The method further comprises slideably inserting the rail base extension within the rail framing member second receiving channel such that the rail base extension mating surfaces cooperate with the internal surfaces of the rail framing member second receiving channel walls, and securing the rail base extension to the rail framing member using the fastener.

One of the rail base extension mating surfaces or rail framing member receiving channel walls may comprise an elongated groove and the other of the rail base extension mating surfaces or the rail framing member receiving channel walls may include an elongated protrusion, and the step of slideably inserting the rail base extension within the rail framing member second receiving channel may further comprise slideably receiving the elongated protrusion within the elongated groove.

In an embodiment, the rail base extension mating surfaces and the rail framing member receiving channel walls may each include at least one corresponding discontinuity for providing additional mating surfaces when the rail base extension is slidably inserted within the rail framing member second receiving channel, and the step of slideably inserting the rail base extension within the rail framing member second receiving channel may further comprise mating the corresponding discontinuities.

The rail base extension may further comprise a horizontally-oriented linking plate at a top end thereof, the linking plate including in an elongated groove, and the step of securing the rail base extension to the rail framing member may further comprise inserting the fastener within the linking plate elongated groove and driving the fastener into the rail framing member partition plate. The fastener may be a set screw which abuts a detent in the rail framing member partition plate to secure the rail base extension to the rail framing member.

The method may further comprise securing a panel within the rail framing member first receiving channel, the panel secured along an edge thereof.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
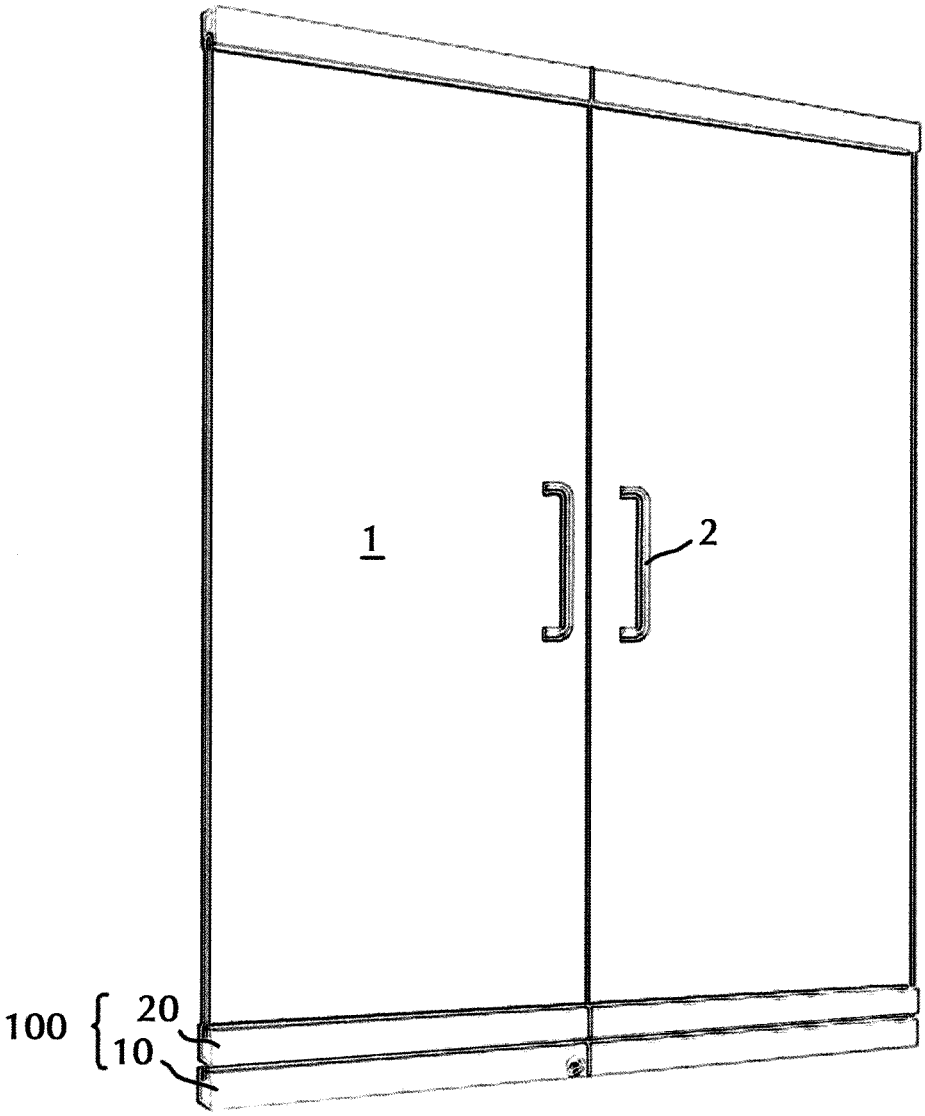
FIG. 1 is a front perspective view of a glass door entryway including a modular door rail according to the present invention.

In describing the embodiments of the present invention, reference will be made herein to FIGS. 1-6 of the drawings in which like numerals refer to like features of the invention.

Certain terminology is used herein for convenience only and is not to be taken as a limitation of the invention. For example, words such as "upper," "lower," "left," "right," "horizontal," "vertical," "upward," and "downward" merely describe the configuration shown in the drawings. For purposes of clarity, the same reference numbers will be used in the drawings to identify similar elements.

The modular rail system of the present invention relates to door rail systems conventionally used to hold plate glass panes or panels, either in a doorway opening or for use as a wall partition, wherein the rail system runs along one or more edges of the panel and secures the panel at its edges. Typical door rail systems can accommodate a 4" or 6" door rail, and if an increased rail height is required, the vendor will use a false cladding on the top of the rail, causing the customer to have to buy an additional piece of glass to accommodate the difference in rail height, and requiring significant additional tooling and cost. The modular rail system of the present invention provides a means to create an extended door rail height, such as a 10" door rail, from an existing conventional 4" or 6" door rail, without requiring additional glass hardware or significant tooling.

The modular rail system of the present invention includes a rail base extension which is adapted to be slideably received and secured within a bottom channel of an otherwise conventional rail framing member. The base extension comprises vertically-oriented sides which are adapted to mate with the side members of the rail framing member above to create an extended flush, solid exterior rail surface, which allows for an extended rail height without the need for false cladding typically used to "extend" the rail height in prior art designs. The base extension further comprises an accessory channel space which can be used to hold various door-related accessories, which are normally hidden within the rail framing member.

One embodiment of the modular rail assembly 100 of the present invention is shown in FIGS. 1-6, inclusive. FIG. 1 depicts a double glass door assembly comprising a pair of glass panes or panels 1 situated within a door frame (not shown, for clarity). Attached to each panel is a handle 2 for opening/closing one half of the double glass door. Each glass panel 1 is pivotable about a hinge (not shown) at an opposite edge of the panel. As shown in FIG. 1, glass panel 1 is attached to a rail framing member 20 at the bottom edge of the panel by known methods. A rail base extension 10 secured to the bottom portion of framing member 20 completes the modular rail assembly and serves to increase the rail height to a desired height in excess of a conventional door rail. As shown in FIG. 1, modular rail assembly 100 comprises a housing which runs along the entire length of panel 1. Cladding, such as in the form of aluminum or brass plates, may be placed over the exposed exterior surfaces of the housing by conventional means, such as an adhesive.

Figure 2:
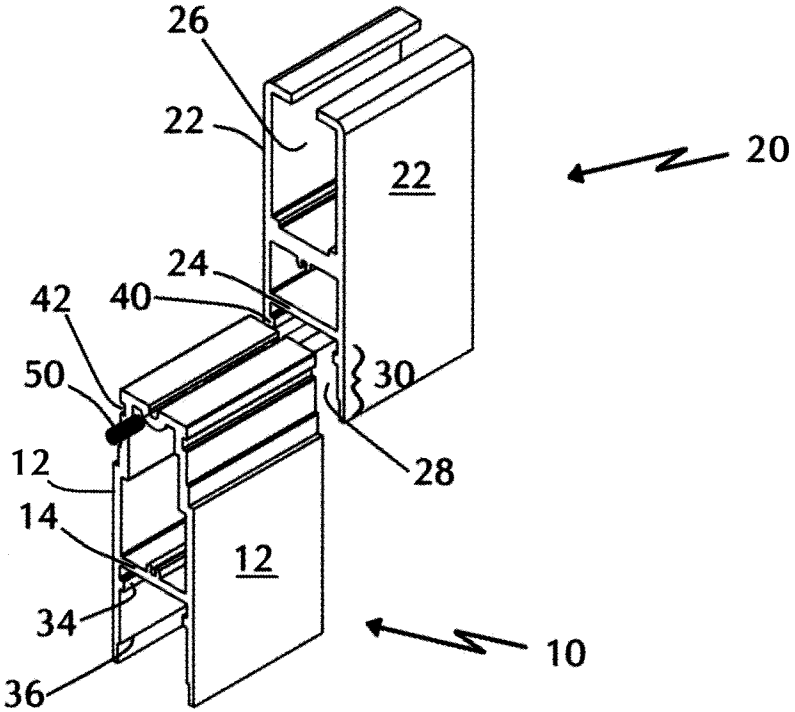
FIG. 2 is a front left top perspective view of a portion of an exploded modular door rail according to the present invention.
Figure 5:
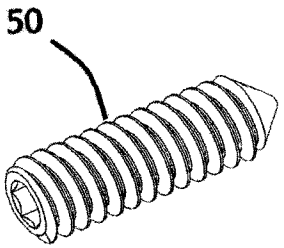
FIG. 5 is a perspective view of a set screw used in assembly of the modular door rail shown in FIG. 1.
Figure 4:
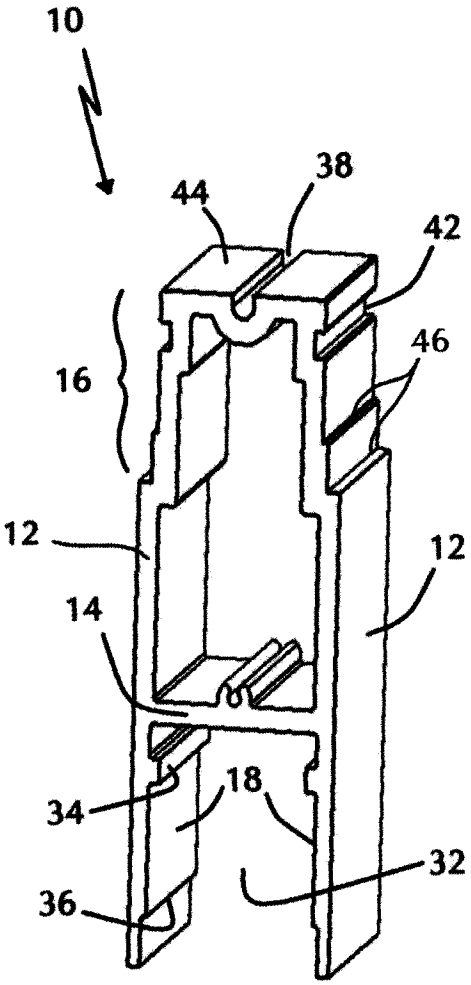
FIG. 4 is a left front top perspective view of the modular door rail shown in FIG. 2.

Turning now to FIG. 2, an exploded perspective view of a portion of a modular door rail system according to the present invention is shown. The modular assembly 100 includes a rail base extension 10 securable to an otherwise conventional rail framing member 20. In an embodiment, both of the rail base extension 10 and rail framing member 20 may be made of extruded aluminum; however it should be understood by those skilled in the art that the modular rail system of the present invention is not limited to such materials and that other materials may also be used to form the rail framing member and base extension. Rail base extension 10 includes a pair of vertically-oriented sides 12 interconnected by a horizontally-oriented partition plate 14 to form a housing (FIG. 4). FIG. 4 shows one embodiment of a rail base extension according to the present invention, and it should be understood by those skilled in the art that in this or other embodiments that sides 12 may run along the entire length and/or height of the door, as shown in FIG. 1.

Figure 3:
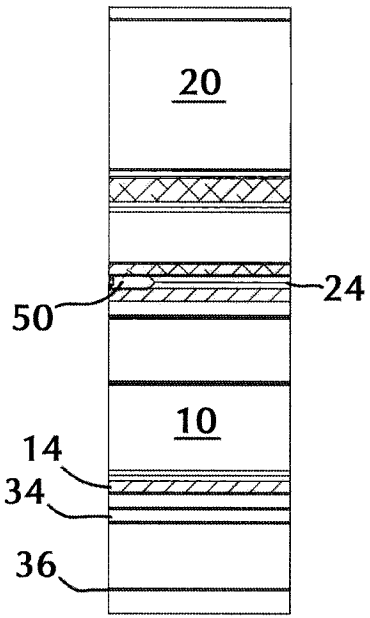
FIG. 3 is cross-sectional view of the assembled modular door rail shown in FIG. 6, taken along line 3-3.

Sides 12 have mating surfaces 16 on opposing external surfaces thereof for mating with the interior surface of the channel walls 30 of the lower receiving channel 28 of rail framing member 20, as shown in FIGS. 2-4 and as will be described in more detail below. In an embodiment, mating surfaces 16 comprise a top portion of the external surfaces of housing sides 12, shown as approximately the top one-third of the height of sides 12 (FIG. 4). It should be understood by those skilled in the art that the configuration of the mating surfaces 16, 30 can be customized per field requirements and to meet required tolerances, and is not limited to the configuration shown.

Figure 6:
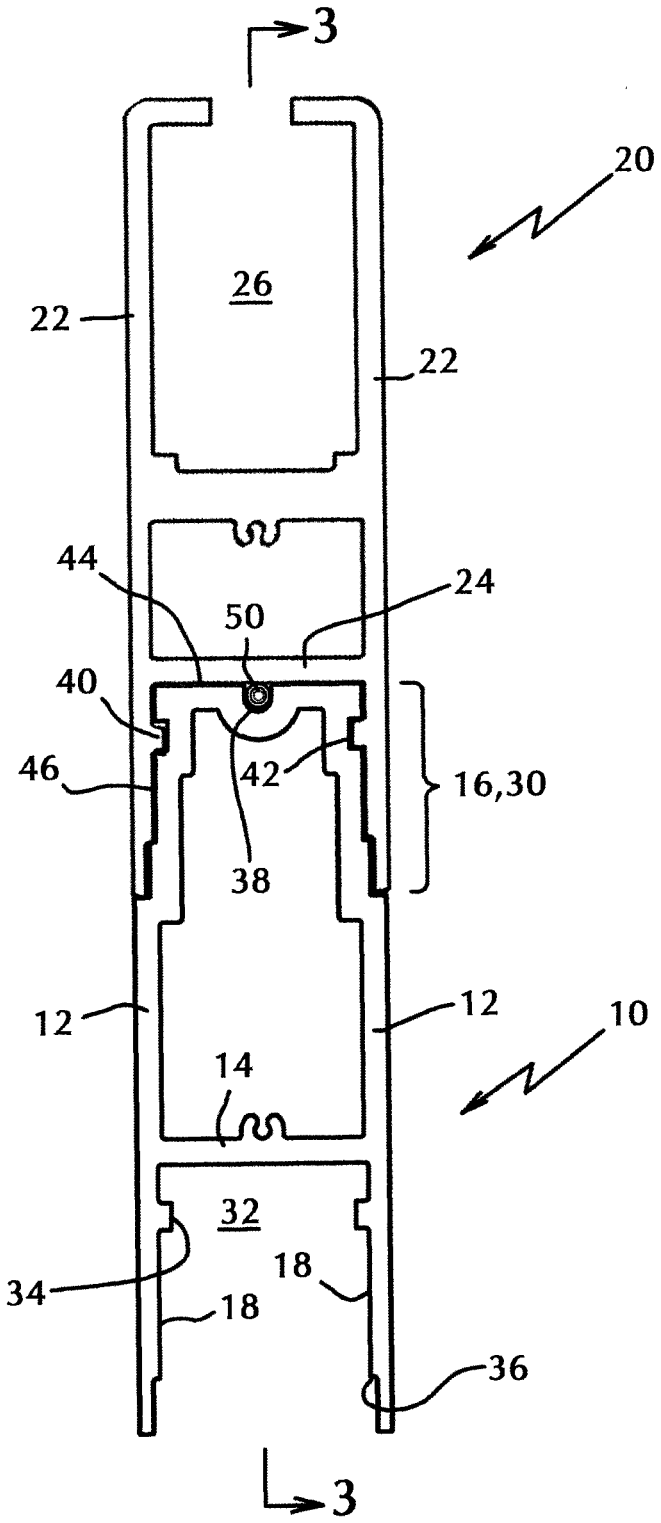
FIG. 6 is an assembled left side elevational view of the modular door rail shown in FIG. 2.

As further shown in FIG. 2, rail framing member 20 comprises a housing including a pair of vertically-oriented sides 22 interconnected by a horizontally-oriented partition plate 24 to form top and bottom receiving channels 26, 28 on opposite sides of the partition plate 24. Top receiving channel 26 is otherwise similar to that of a conventional door frame for receiving a glass panel (not shown), and a description of its construction is therefore omitted. The glass panel may be permanently attached to the rail framing member within top receiving channel 26, or alternatively, the panel may be detachably removed by way of a clamping mechanism positioned inside the rail housing (not shown). Bottom receiving channel 28 is defined at a top side by partition plate 24 and on opposing sides by receiving channel walls 30. Walls 30 are slidably mated with the opposing mating surfaces 16 of the rail base extension 10 when the base extension is slideably inserted into the rail framing member bottom receiving channel 28, as shown in FIG. 6. A conventional fastener 50 may be used to temporarily secure the rail base extension 10 to the rail framing member 20 until clamping can occur. As shown in FIG. 6, when assembled, the exterior surfaces of the rail base extension 10 and the rail framing member 20 provide an extended flush, solid extruded aluminum rail surface, which allows for an extended rail height without the need for false cladding typically used to "extend" the rail height in prior art designs, and without requiring the purchase of a new glass panel.

In an embodiment, as shown in FIG. 4, rail base extension 10 may further include channel walls 18 defining an accessory channel space 32 defined at a top side by partition plate 14. Accessory channel space 32 can be used to hold various door-related accessories (not shown), such as tumbler locks, end-loading arms, side-loading arms, pivots, sweeps and dust barriers. In at least one embodiment, channel walls 18 may include features such as protrusions 34 and discontinuity 36 that help to secure accessories within accessory channel 32. According to some embodiments of the present invention, accessory channel space 32 may also be used to provide access to fastening hardware, such as screw(s) which extend through clearance holes (not shown) in the rail base extension partition plate 14 and horizontally-oriented linking plate 44, and into a glass panel clamping assembly (not shown) in the rail framing member 20 secured above.

As shown in FIGS. 2-4, the fastener for securing rail base extension 10 to rail framing member 20 may be a steel set screw (FIG. 5) which is received in an elongated groove 38 in rail base extension linking plate 44 (FIGS. 2, 4 and 6). As best shown in the cross-sectional view of FIG. 3, the set screw 50 is rotated until it abuts a detent in rail framing member partition plate 24 to ensure proper nesting of the screw. As the set screw 50 is typically comprised of hardened steel, the set screw is able to deform the extruded aluminum rail framing member 20 and partition plate 24 during tightening of the set screw and assembly of the modular door rail system.

As shown in FIG. 2, and best seen in FIG. 4, in at least one embodiment of the present invention, the external mating surfaces 16 of rail base extension 10 may include one or more elongated grooves 42 for cooperating with projections 40 on the internal mating surfaces of the rail framing member receiving channel walls 30 (FIG. 6). In other embodiments the configuration may be reversed, such that external mating surfaces 16 may include one or more projection(s) which cooperate with elongated grooves in the rail framing member receiving channel walls 30. When rail base extension 10 is slidably inserted within the rail framing member bottom receiving channel 28 during assembly of the modular door rail system, as shown in FIGS. 2 and 6, protrusions 40 are correspondingly received in grooves 42, providing additional mating surfaces therebetween. In one or more embodiments, rail base extension mating surfaces 16 and rail framing member receiving channel walls 30 may further include one or more corresponding ridges or discontinuities 46 for providing additional mating surfaces (FIG. 6). The configuration of the mating surfaces 16, 30, including various corresponding protrusions, grooves and ridges or discontinuities, as shown in FIG. 6, is customizable per field requirements and to meet required tolerances, and those skilled in the art should understand that the modular rail system of the present invention is not limited to the configuration shown.

An advantage of the modular system of the present invention is that it is fully customizable. Provided that the customer allows enough time for tooling, a vendor could adapt the door rail to any desired height from a conventional 4" or 6" rail, such as creating a 10" door rail from a 4" door rail, an 8" door rail from a 4" door rail, or a 6" door rail from a 4" door rail. Moreover, the modular design of the present invention eliminates the need to purchase additional glass, as well as providing a more solid rail. For example, if the top of the rail is hit where the cladding is positioned, the cladding will not bend due to the fact that there is a solid piece of extruded aluminum behind it, as opposed to sheet metal and tape, as in the prior art designs. The present invention further eliminates the need for false cladding typically used to "extend" the door rail.

Thus, the present invention provides a modular door rail for a glass door which eliminates the need to purchase a new, larger piece of glass when a larger glass door is required. The present invention also provides a modular door rail extension which is securable to an existing glass door rail and extends the door rail for panels shorter than the door frame into which the door is installed. The present invention also provides a modular door extension for field installation which is easily secured to an existing glass door rail. The present invention also provides a customizable modular rail assembly including a rail build-up piece that allows for the creation of a larger door rail from an existing smaller rail.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A modular rail assembly for securing a panel in a door or window, comprising:

a rail framing member having vertically-oriented sides interconnected by a partition plate to form first and second receiving channels on opposite sides of the partition plate, the second receiving channel defined at a top side by the partition plate and on opposing sides by receiving channel walls, the rail framing member having a height equal to a length of its vertically-oriented sides;

a rail base extension slideably secured within the rail framing member second receiving channel and at least partially extending below the rail framing member vertically-oriented sides, external surfaces of the rail framing member and rail base extension forming a substantially flush continuous exterior rail surface when viewed in a direction normal to a longitudinal axis of the modular rail assembly, the rail base extension including vertically-oriented sides interconnected by a partition plate, the rail base extension sides having mating surfaces on opposing external surfaces thereof for mating with internal surfaces of the rail framing member second receiving channel walls, the combination of the rail framing member and rail base extension having a height greater than the height of the rail framing member;

a fastener securing the rail base extension to the rail framing member; and a panel secured along an edge thereof in the first receiving channel of the rail framing member.

2. The modular rail assembly of claim 1 wherein one of the rail base extension mating surfaces or the rail framing member receiving channel walls comprises an elongated groove and the other of the rail base extension mating surfaces or the rail framing member receiving channel walls includes an elongated protrusion capable of being slidably received in the elongated groove when the rail base extension is slidably inserted within the rail framing member second receiving channel.

3. The modular rail assembly of claim 1 wherein the rail base extension mating surfaces and the rail framing member receiving channel walls each include at least one corresponding discontinuity, the corresponding discontinuities providing additional mating surfaces when the rail base extension is slidably inserted within the rail framing member second receiving channel.

4. The modular rail assembly of claim 1 wherein the rail base extension further comprises channel walls defining an accessory channel space defined at a top side by the rail base extension partition plate.

5. The modular rail assembly of claim 4 wherein the rail base extension channel walls include at least one of a protrusion and a discontinuity on an interior surface thereof for securing one or more door-related accessories within the accessory channel space.

6. The modular rail assembly of claim 1 wherein the rail base extension further comprises a horizontally-oriented linking plate at a top end thereof, the linking plate including in an elongated groove for receiving the fastener securing the rail base extension to the rail framing member.

7. The modular rail assembly of claim 6 wherein the fastener is a set screw which abuts a detent in the rail framing member partition plate to secure the rail base extension to the rail framing member.

8. A method of assembling a rail assembly for securing a panel in a door or window, comprising:

providing a rail framing member having vertically-oriented sides interconnected by a partition plate to form first and second receiving channels on opposite sides of the partition plate, the second receiving channel defined at a top side by the partition plate and on opposing sides by receiving channel walls, the rail framing member having a height equal to a length of its vertically-oriented sides;

providing a rail base extension adapted to be received within the rail framing member second receiving channel, the rail base extension including vertically-oriented sides interconnected by a partition plate, the rail base extension sides having mating surfaces on opposing external surfaces thereof for mating with internal surfaces of the rail framing member second receiving channel walls;

providing a fastener for securing the rail base extension to the rail framing member;

slideably inserting the rail base extension within the rail framing member second receiving channel such that the rail base extension mating surfaces cooperate with the internal surfaces of the rail framing member second receiving channel walls and the rail base extension extends at least partially below the rail framing member vertically-oriented sides, wherein external surfaces of the rail framing member and rail base extension form a substantially flush continuous exterior rail surface when viewed in a direction normal to a longitudinal axis of the rail assembly; and securing the rail base extension to the rail framing member using the fastener such that a height of the assembled rail assembly is greater than the height of the rail framing member.

9. The method of claim 8 wherein one of the rail base extension mating surfaces or rail framing member receiving channel walls comprises an elongated groove and the other of the rail base extension mating surfaces or the rail framing member receiving channel walls includes an elongated protrusion, and wherein the step of slideably inserting the rail base extension within the rail framing member second receiving channel further comprises slideably receiving the elongated protrusion within the elongated groove.

10. The method of claim 8 wherein the rail base extension mating surfaces and the rail framing member receiving channel walls each include at least one corresponding discontinuity, the corresponding discontinuities providing additional mating surfaces when the rail base extension is slidably inserted within the rail framing member second receiving channel, and wherein the step of slideably inserting the rail base extension within the rail framing member second receiving channel further comprises mating the corresponding discontinuities.

11. The method of claim 8 wherein the rail base extension further comprises a horizontally-oriented linking plate at a top end thereof, the linking plate including in an elongated groove, and wherein the step of securing the rail base extension to the rail framing member further comprises inserting the fastener within the linking plate elongated groove and driving the fastener into the rail framing member partition plate.

12. The method of claim 11 wherein the fastener is a set screw which abuts a detent in the rail framing member partition plate to secure the rail base extension to the rail framing member.

13. The method of claim 8 further including securing a panel within the rail framing member first receiving channel, the panel secured along an edge thereof.

14. A modular rail assembly for securing a panel in a door or window, comprising:

a rail framing member having vertically-oriented sides interconnected by a partition plate to form first and second receiving channels on opposite sides of the partition plate, the second receiving channel defined at a top side by the partition plate and on opposing sides by receiving channel walls, the rail framing member having a height equal to a length of its vertically-oriented sides; and a rail base extension slideably secured within the rail framing member second receiving channel and at least partially extending below the rail framing member vertically-oriented sides, external surfaces of the rail framing member and rail base extension forming a substantially flush continuous exterior rail surface when viewed in a direction normal to a longitudinal axis of the modular rail assembly, the rail base extension including vertically-oriented sides interconnected by a partition plate, the rail base extension sides having mating surfaces on opposing external surfaces thereof for mating with internal surfaces of the rail framing member second receiving channel walls, wherein a height of the modular rail assembly is greater than the height of the rail framing member.

15. The modular rail assembly of claim 14 wherein one of the rail base extension mating surfaces or the rail framing member receiving channel walls comprises an elongated groove and the other of the rail base extension mating surfaces or the rail framing member receiving channel walls includes an elongated protrusion capable of being slidably received in the elongated groove when the rail base extension is slidably inserted within the rail framing member second receiving channel.

16. The modular rail assembly of claim 14 wherein the rail base extension mating surfaces and the rail framing member receiving channel walls each include at least one corresponding discontinuity, the corresponding discontinuities providing additional mating surfaces when the rail base extension is slidably inserted within the rail framing member second receiving channel.

17. The modular rail assembly of claim 14 wherein the rail base extension further comprises channel walls defining an accessory channel space defined at a top side by the rail base extension partition plate.

18. The modular rail assembly of claim 17 wherein the rail base extension channel walls include at least one of a protrusion and a discontinuity on an interior surface thereof for securing one or more door-related accessories within the accessory channel space.

19. The modular rail assembly of claim 14 wherein the rail base extension further comprises a horizontally-oriented linking plate at a top end thereof, the linking plate including an elongated groove for receiving a fastener for securing the rail base extension to the rail framing member.

* * * * *